United States Patent [19]

Harris et al.

[11] Patent Number: 4,774,101

[45] Date of Patent: Sep. 27, 1988

[54] AUTOMATED METHOD FOR THE ANALYSIS AND CONTROL OF THE ELECTROLESS METAL PLATING SOLUTION

[75] Inventors: John E. Harris, Richmond; Walter H. Rees, Jr., Mechanicsville, both of Va.

[73] Assignee: American Telephone and Telegraph Company, AT&T Technologies, Inc., Berkeley Heights, N.J.

[21] Appl. No.: 940,464

[22] Filed: Dec. 10, 1986

[51] Int. Cl.[4] ..... B05D 1/04

[52] U.S. Cl. ..... 427/8; 427/345; 427/443.1

[58] Field of Search ..... 427/8, 345, 443.1

[56] References Cited

U.S. PATENT DOCUMENTS

| | | | |
|---|---|---|---|
| 4,286,965 | 9/1981 | Vanhumbeeck | 427/8 |
| 4,350,717 | 9/1982 | Araki | 427/8 |
| 4,623,554 | 11/1986 | Kaschak | 427/8 |
| 4,650,691 | 3/1987 | Kinoshita | 427/8 |

FOREIGN PATENT DOCUMENTS

| | | | |
|---|---|---|---|
| 1588758 | 4/1981 | United Kingdom | 427/8 |

*Primary Examiner*—Michael R. Lusignan
*Assistant Examiner*—Marianne L. Padgett
*Attorney, Agent, or Firm*—Roderick B. Anderson; Joel F. Spivak

[57] ABSTRACT

An apparatus coupled to an electroless copper plating bath for analyzing and controlling, on-line, the primary constituents of the bath is described. The apparatus detects and controls not only the copper concentration of the bath by optical means, but the concentrations of hydroxyl ion, formaldehyde reducing agent and cyanide ion as well.

10 Claims, 3 Drawing Sheets

AUTOMATED METHOD FOR THE ANALYSIS AND CONTROL OF THE ELECTROLESS METAL PLATING SOLUTION

TECHNICAL FIELD

This invention relates to a method and system for the analysis and control of electroless metal plating solutions, and more specifically, to electroless copper plating solutions.

BACKGROUND OF THE INVENTION

In order for an electroless metal plating bath to plate the desired metal with good physical properties, e.g., ductility, adhesion, density, etc., at an acceptable deposition rate, a number of chemical components of the plating solution must be controlled within specific ranges. For example, the major components that are normally analyzed in an electroless copper plating solution are copper, sodium hydroxide and formaldehyde. The maintenance of the concentrations of these components within specified ranges is critical to the proper operation of the electroless plating bath and the quality of the resultant metal film deposited therefrom. Traditionally, the quantitative analysis of these constituents has been performed off-line, in a process control laboratory. Based upon the results of these off-line analyses, the quantities of make-up to maintain the bath within proper operating ranges was calculated and the appropriate quantity was added to the plating bath. This method was not only time consuming, but due to the time lag and inaccuracy found in prior art analytical techniques, various other problems existed.

In recent years, some commercial control units have become available for on-line use, however, these controllers do not provide quantitative information. They are merely setpoint controllers as opposed to an analyzer-controller combination. Setpoint controllers respond to deviations from a desired level but give no information about the actual concentration of the component being controlled. Anaylzer-controllers, on the other hand, provide information about the component concentration as well as perform the control function.

We have now invented an automated, computer controlled method for analyzing and controlling the bath chemistry of electroless metal plating baths which allow unattended operation of the bath for extended periods of time, as well as the ability to monitor the bath chemistry.

SUMMARY OF THE INVENTION

Figure 1:
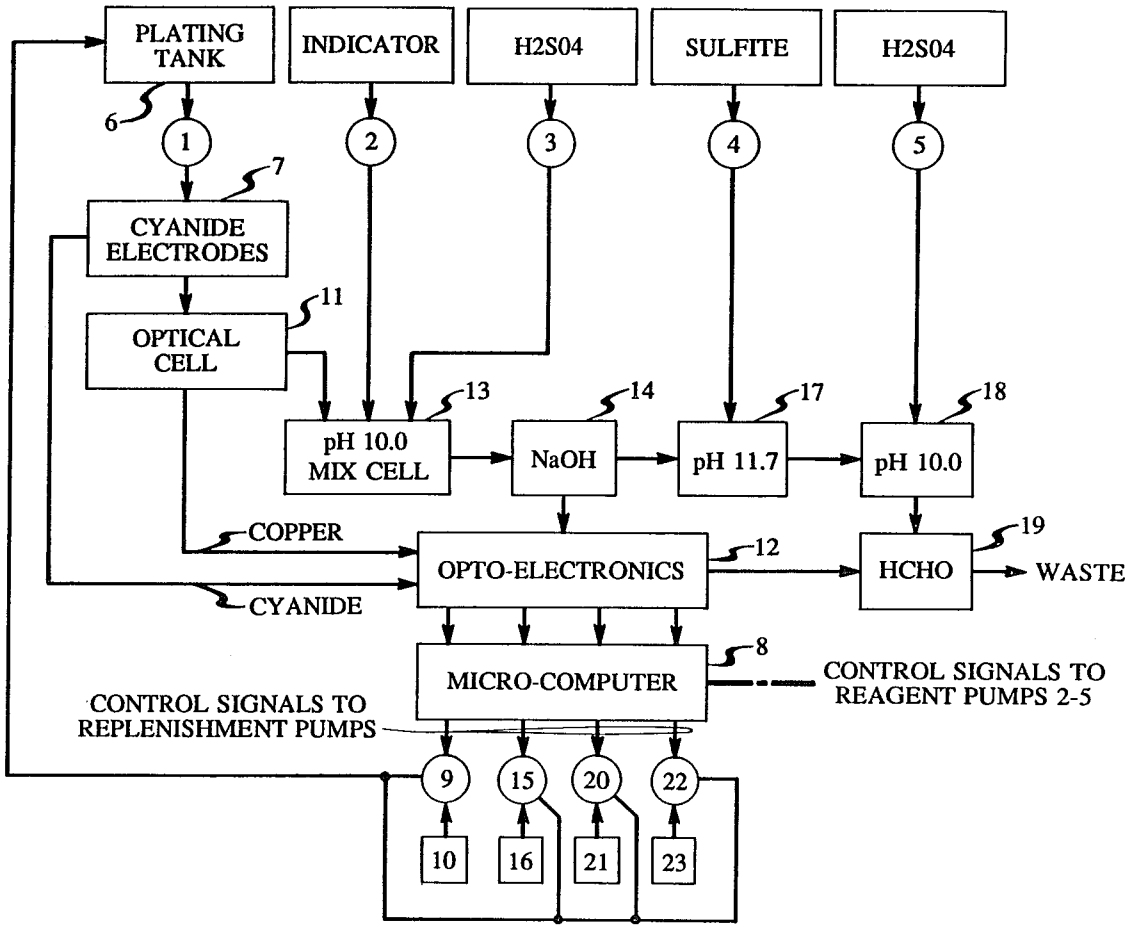
FIG. 1 is a schematic flow diagram showing the operation of a preferred analyzer-controller system.

The subject invention describes a method and apparatus for analyzing and controlling the concentrations of metal ions, free hydroxyl or hydrogen ions and reducing agents in an electroless metal plating bath to maintain the bath chemistry in suitable operable compositional ranges. The method may be summarized as a method for analyzing and controlling the composition of a metal electroless plating bath which bath comprises, as components thereof, metal ions, free hydroxyl and/or hydrogen ions and a reducing agent, the method comprising the steps of: (1) regularly diverting a portion of said bath to an analyzer capable of automatically analyzing the concentrations of each of said components; (2) automatically analyzing the concentration of said component in said analyzer; (3) sending electrical output signals representing the concentrations of each of said analyzed component from said analyzer to a comparator means for comparing, by the use of software, the measured concentrations of said components with a standard concentration for each component; and (4) coupling the respective outputs of said comparator to the respective solution make-up tanks which have an outlet into the metal electroless plating bath such that the amount of make-up solution allowed to flow from the make-up tank to the electroless plating bath is determined by the output from said comparator.

The apparatus includes means coupled to the plating bath for regularly diverting a portion of the bath to an analyzer section. The analyzer, which receives the diverted portion of the bath, automatically determines the concentration of the constituents of the bath passing therethrough. More particularly, the analyzer determines the concentrations of the metal to be plated, hydroxyl or hydrogen ions and reducing the agent in the bath. The apparatus includes means for comparing the measured concentrations of each of the constituents against a standard concentration for each constituent. The apparatus further includes means, responsive to the difference between the respective measured concentrations and the standard concentrations, for automatically replenishing the bath such that the concentration of each of the analyzed components is adjusted to fall within the standard concentration range.

DETAILED DESCRIPTION

Generally, this invention is directed to a system for analysis and control of electroless plating baths and, in particular, copper plating baths, and fills a need for improvement in chemistry control for such baths. The new system employs a computerized pump control and optical means for determining the concentration of the critical components of the bath which are analyzed by the system. These components are the metal (copper, in the case of the copper plating solution), hydroxyl ion concentration (generally as sodium hydroxide), and reducing agent concentration (generally formaldehyde in the case of copper plating solutions). We have also determined that it is advantageous, in electroless copper plating solutions, to monitor and control the cyanide ion concentration of the plating solution. Copper content is determined by the absorbance of monochromatic light passed through a spectrophotometric cell containing a sample of the bath. Sodium hydroxide is measured by acid-based titrations utilizing an optical end point detection. Similarly, formaldehyde is determined by acid-based titrations following the addition of sodium sulfite to react with formaldehyde utilizing an optical end point. The cyanide level is measured with specific ion electrodes.

The analyzer-controller system contains a micro computer which controls stepping motors for delivery of titrant and also reads detector voltages resulting from the analyzer, comparing these voltages to desired standards for each component. The computer provides a display of bath component concentrations in engineering units and further the output of the computer control bath replenishment pumps which are coupled to replenishment reservoirs. One major advantage of the system is its use as an on-line system for controlling and monitoring the chemistry of electroless plating solutions. One advantage of the novel invention is the elimination of standard pH electrodes, the use of which in the past has given to various maintenance problems in commercial analyzers. Another advantage of the novel system is that in addition to being a setpoint controller, it provides analytical information concerning the actual concentration in the electroless plating bath of the components being controlled.

Controller Requirements

The desired control windows for a commercial full-build type electroless copper plating bath is a variation of less than about ±10%. Further, a controller for an electroless copper plating bath must be able to maintain the principle solution components within the specified range throughout the plating cycle. Typical commercial full-build electroless copper baths typically can have a plating cycle of from 18–24 hours, depending on the desired thickness of the copper deposit. Further, 4 or 5 plating cycles per week may be employed. Hence, the controller must be able to operate unattended for extended periods.

Bath control is generally maintained by cycling replenishment pumps on and off in response to shifts away from the desired setpoint. Alternatively, one may employ a proportional controller wherein the controller logic responds to a proportional difference between a measured value and a setpoint.

The particular full-build electroless copper plating bath used in testing the novel system has desired control ranges for the three major components as follows:

| | |
|---|---|
| Copper (metal) | 1.7 to 2.0 g/l |
| Sodium hydroxide | 2.7 to 3.2 g/l |
| Formaldehyde | 1.6 to 2.0 g/l |

The optimum levels are in the middle of these ranges. If kept within these ranges, the resultant metal deposit meets all the required specifications.

Analytical Techniques

Three different analytical methods are used in the system. Copper is analyzed optically. The copper concentration is determined from the use of Beer's law based upon the absorbance of monochromatic light by the sample solution. Typically, a sample stream is diverted from the electroless copper plating bath through a spectrophotometric cell that has a fixed path length, e.g., one centimeter. Light from a light source, e.g., a quartz halogen lamp, is carried to the flow cell via a fiber optic cable. On the receiving side of the cell is a bifurcated fiber bundle that carries the transmitted light to two narrow band interference filters that select the appropriate wavelengths to be transmitted to the photodetectors. One is a signal wavelength measuring the attenuation of light passing through the cell and the other is a reference wavelength. The signal wavelength for copper is 685 nm and the reference wavelength is 450 nm. The reference is a zero point that provides compensation for changes in light intensity and contamination of optical surfaces. Currents from the photodetectors are converted to voltages and fed into an electronic module that produces a voltage proportional to the log of the ratio of the two input voltages to the module in accordance with Beer's law. This voltage is read by a computer and converted, in accordance with the software in the computer, to engineering units for display.

The sodium hydroxide level in a typical commercial electroless copper controller is measured by acid-base titration using a pH electrode to determine when the desired endpoint is reached. The use of such electrodes, especially in on-line type analysis, has been met with various problems. In the preferred embodiment of the novel system, the sodium hydroxide level is detected optically by adding a pH-sensitive indicating solution having a color transition range near the desired pH, e.g., phenolphthalein, which has a color transition in a pH range of about 8–10. Changes in the color density of the indicator relate to shifts in solution pH away from the desired endpoint. This method eliminates pH electrodes and their associated maintenance problems.

In order to reach a constant endpoint, the total volume of titrant added to the sample must vary with the sodium hydroxide level in the sample. To meet this need, a variable speed pump is used to deliver the titrant. One pumping mechanism which is suitable employs small stepping motors which drive peristaltic pumps at whatever speed necessary to reach the desired pH endpoint. The inclusion of a computer in the system simplifies the use of a feedback loop to control the stepping motor speed.

Sodium hydroxide analysis in the novel system proceeds as follows: After the sample taken from the electroless plating bath passes through the copper analysis cell, it flows into a mixing cell where indicator solution is added at a constant rate and titrant, e.g., sulfuric acid, which is added at a variable rate. The mixed solution then flows to a second optical cell where the absorbance of the indicator is measured. The computer reads the output from this second set of photodetectors, which output is fedback so as to make adjustments in the stepping motor rate to maintain a constant endpoint pH of 10.0 in the mixing cell. Since the stepping motor speed is proportional to the sodium hydroxide concentration in the sample, the computer uses this speed to calculate the sodium hydroxide concentration in engineering units and to control the sodium hydroxide addition to the electroless plating bath from a sodium hydroxide make-up reservoir.

Formaldehyde is analyzed by an acid-based titration of the free hydroxide generated when excess sodium sulfite is reacted with the formaldehyde in solution. The same optical endpoint detection method and titrant delivery system as described for the sodium hydroxide section are used in the formaldehyde analysis section.

The formaldehyde analysis proceeds as follows: After leaving the optical cell in the sodium hydroxide section of the system, the solution, at a pH of 10.0, flows into a second mixing cell where sodium sulfite solution is added at a constant rate. From this cell the solution, now at a pH of 11.7, flows to a third mixing cell where sulfuric acid (0.2 normal) is added at a variable rate. The mixed solution then flows into a third optical cell where the indicator absorbance is measured. Feedback of this absorbance information through the computer controls the second titrant delivery pump such that a pH of 10.0 is maintained in the third mixing cell. Just as in the sodium hydroxide section, the speed of the second stepping motor is proportional to the formaldehyde concentration in the sample stream. The computer reads this motor speed and converts to engineering units for display and for controlling the amount of formaldehyde to be added to the electroless plating bath from a make-up reservoir.

In addition to measurement of the critical components mentioned above, we have discovered that it is also beneficial to measure and control cyanide ion concentration. Cyanide ions exists in small quantities (50–100 ppm) in electroless copper baths as part of a stabilizer system. One simple way to measure the relative ion concentration of cyanide ions is with specific ion electrodes. Cyanide ions in solution react with material in the end of the specific ion electrode to produce a potential difference between the ion electrode and the reference electrode. This potential difference is proportional to the cyanide ion concentration in solution. The specific ion electrode and its reference are positioned in the incoming sample stream. The electrodes are connected to a specific ion meter, e.g., an Orion pH/specific ion meter, that provides an output voltage that can be read by the computer and then displayed. The same output may then be used to control the quantity of cyanide ion allowed to enter the electroless plating bath from a cyanide ion make-up reservoir.

While the described procedure for analyzing each of the components is sequential in nature, it should be understood that one can divide the sampling streams into separate portions which are fed into the individual analyzer units in parallel.

Referring to FIG. 1, there is shown a general schematic diagram of the novel system. In this figure, a fluid flow is represented by lines with arrows, and optical and/or electronic coupling for measurement and passage of electronic signals generated are represented by lines without arrows. The system generally comprises a plurality of input pumps 1–5, each coupled to a different source for supplying a different fluid to the analytical system. Pump 1 extracts sample fluid from the electroless plating tank 6 and passes it through an optical cyanide detection cell 7. The voltage generated at the electrodes of the cyanide detection cell is amplified and sent to a micro computer 8, where the reading is processed and which provides an output control signal to a pump 9, which pumps fluid from a cyanide ion reservoir 10 into the plating tank 6 to make up for depleted cyanide ions as detected by the analyzer. This sample fluid passing through the cyanide cell 7 then enters an optical copper detection cell 11. The cell 11 is in the light path of an opto-electronic section 12 of the system. The opto-electronic section 12 provides the required monochromatic light beam, photodetectors and electronics for measuring the optical density and/or change in transmission of the light as it passes through an optical cell, such as the copper detection cell 11. An output signal from the opto-electronic section 12 is input to the micro computer 8 which, in turn, provides a control signal to a copper solution make-up pump 22 which pumps copper solution from a reservoir 23 into the plating tank 6. The sample fluid from the copper detection cell 11 then flows into a mixing cell 13 where the solution is mixed with a pH indicator, e.g., phenolphthalein, which is pumped into the mixing cell 13 by means of pump 2. Sulfuric acid titrant is also pumped into the mixing cell 13 by means of pump 3. It should be noted that, optionally, pumps 1–5 may be controlled by outputs from the micro computer so as to limit the quantity of the various fluids pumped in response to measured signals. The mixed fluid from the mixing cell 13 is then passed into an optical cell 14 for detecting hydroxyl ions. The concentraton of hydroxyl ions is determined by use of the opto-electronics section 12. In this instance, the quantity of titrant needed to effect a color change of the optical indicator is determined by means of signals provided to the computer 8. The computer 8 then provides control signals to the hydroxide make-up pump 15, which pumps a calculated amount of hydroxide solution from a hydroxide make-up reservoir 16 into the copper plating tank 6. The fluid passing through the optical cell 14 then passes through a reducing agent reaction cell 17 where the reducing agent, e.g., formaldehyde, is reacted, e.g., with sulfite ion, to form an acid titratable species. The sulfite ion is provided to the reaction cell 17 by means of pump 4 from a sodium sulfite reservoir. The fluid then passes through a titration cell 18 where a controlled amount of titrant, e.g., sulfuric acid, is added by means of pump 5 from an acid reservoir. The end point of the titration is directed optically in the second optical cell 19 by means of the opto-electronic section 12 and is finally emitted from the analyzer-controller as waste. The output from the opto-electronics section 12 provides an input to the micro computer 8 which determines the formaldehyde concentration in the sample based upon the signal from the opto-electronics section 12 for the formaldehyde detection. The micro computer 8 then provides a control signal to a replenishment pump 20 which pumps an amount of formaldehyde as calculated by the micro computer 8 from a formaldehyde reservoir 21 as is necessary to bring the formaldehyde concentration up to the desired level in the electroless plating tank 6.

More specifically, the hardware for the system can be divided into four categories: hydraulics, optics, electronics and the computer. The hydraulic section includes everything involved in moving the various liquids from the plating bath through the analyzer and from the make-up reservoirs into the plating bath. The optical portion contains the light transmitting items necessary for the measurements of optical transmission or absorbance. The electronics section has components for signal processing, filtering, and amplification. The computer provides all the internal and external control functions as well as signal conversion to engineering units.

In the preferred embodiment, the hydraulic section comprises a plurality of peristaltic pumps which are used to move sample solution and reagent solutions through the system. Pump head sizes are chosen to obtain nominal flow rates as may be necessary for the individual solutions driven by each pump. The indicator, sample and sodium sulfite pumps all operate at a constant speed while the two acid pumps operate at various speeds determined by the computer. Typical speeds and flow rates are as follows:

| | |
|---|---|
| Indicator | 2 rpm and 0.12 ml/min |
| Sample | 10 rpm and 2.1 ml/min |
| Sodium sulfite | 6 rpm and 1.26 ml/min |

-continued

| | |
|---|---|
| Sulfuric acid | 4–30 rpm and .084–6.3 ml/min |

The mixing cells used to mix the reagents before they pass through the optical cells typically have an internal volume of about 3 milliliters. The solutions are stirred by a teflon coated magnet inside the cell.

A typical light source employed in the optical portion of the system is a quartz halogen lamp. A 10 watt lamp is sufficient. The light beam coming from the lamp may be focused by a lamp envelope which contains a lens therein. Glass fiber optic bundles carry the the light to and from the optical cells. Narrow band interference filters are housed in a housing which also contains photodiode detectors. The diodes are coupled to the electronics section. The filters transmit only the appropriate wavelengths and the photodiodes measure the amount of light being transmitted.

The electronics section of the analyzer processes signals from the photodiodes to provide appropriate voltages for an analog-to-digital converter of the computer. There are three identical circuits, one each for copper, sodium hydroxide and formaldehyde. Current from the photodiodes is fed to the input of an operational amplifier with unity gain. The output from the amplifier is converted to a voltage through a resistor and connected to the input of a log ratio module, e.g., Analog Devices 757N, which provides an output voltage that is proportional to the optical density of the species being measured in the flow cell, in accordance with Beer's law. This voltage is applied to the input of a signal conditioning module, e.g., Analog Devices 2B30K, which provides amplification and filtering before the signal is fed into the computer.

With respect to the motors that are employed in the system, synchronous motors are used in the constant speed application, while gear reduction stepping motors are preferred in the variable speed application. Suitable motors are Hurst Model T synchronous motors and Hurst Model TS stepping motors with a 10-1 gear reduction. The stepping motors typically have a speed range of 4–30 rpm. These motors are controlled by stepping motor IC chips which receive input signals from a programmable timer module in the computer.

The preferred computer hardware-software portion of the system utilizes a standard microprocessor, e.g., a Motorola 6809 MPU, which has a clock rate of 2 MHz. The computer package includes commercially available timing means which provides all timing signals to the stepping motors.

A pump controller circuit board is provided in the output section of the computer to control the chemical replenishment pumps. A suitable pump controller board is a CMS 9612 prototyping board with an MC68B21 PIA and a 74LS541 buffer. A multiconductor ribbon cable connects this board to a relay box. A suitable software operating system is a multi-user, multi-tasking, real time operating system such as Microware's OS-9 operating system.

The theory of operation of the control software is as follows: The master control loop is in control of all tasks that must be performed on a regular basis. These tasks include the update of the pump motor speed, the display of data to a display screen and the storage of data to a disk, if required. The feedback loop that controls the motor speed is the main task of the control system. The most effective feedback system is a proportional-integral-derivative control loop. In order to maintain an endpoint pH of 10.0 a control loop for the stepping motor speed is required. There are two separate control loops and they are updated regularly, e.g., once a second. The updated motor speed is calculated and sent to the motor control board for each loop. The master control loop is contained in a first software module. This loop is in continuous operation until a signal to end operation is received from the keyboard.

The preferred software package for the control of the system comprises eight modules. These modules include a main module which acts as the software system supervisor and calls all other modules as required. The software modules may be contained in a RAM or a PROM. The program starts with the main module. All values are defined in this module and the master control is contained in it. The first thing this module does is to call a second module to initialize variables. The main module then tests to see if the replenishment pumps are being used and if they are it will test the sample and set up the system. The main module will then paint the information derived from the test on the screen. It will then enter the master control loop where it stays until the program is ended. The master control will first test to see if there has been an input from the keyboard. If not, the loop will update its time of day. If the "second" on the clock has changed, the loop will do a complete internal system update.

A second module is used to read the inputs and convert the readings to a decimal value. This module takes a plurality of readings, rank orders them and selects the median value. This helps reduce the negative effects of noise.

A third module is used to display information on the terminal which is updated once per minute. A fourth module is used to calculate the new motor speed required, each second. The motor speed is equated to the incoming concentration of the solutions. A fifth module converts the motor speed supplied by the fourth module in decimal form into a byte value that is passed to the motor control chip by way of the timer control board. A sixth module is run once each second to determine if it is time to turn off any of the four replenishment pumps. A seventh module is run once a minute to determine how long each replenish pump should run during that minute. An eighth module is run one time at the start of the program. This module initializes all variables and sets up control of the motors. The module then asks how the constants used in the fourth module to figure the new motor speed will be set up, and whether it will be from existing data or from new data. The module may also incorporate a feature where it will then ask if the user wishes to save data or not and one where the module will stablize the control loops before beginning the bath control functions.

Figure 2:
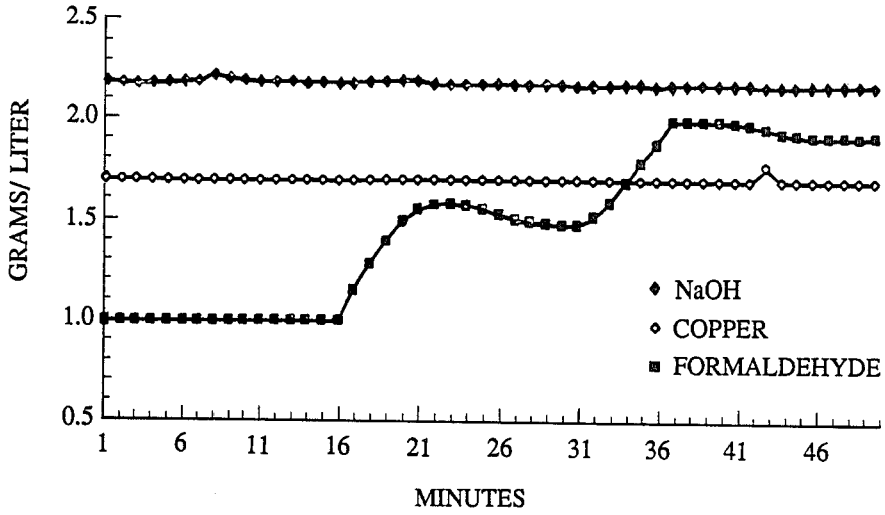
FIG. 2 is a graph showing the change in formaldehyde level as a function of time in an electroless plating bath analyzed with the novel system.

Referring to FIG. 2, there is shown the response of the analyzer control system to step changes in the formaldehyde concentration with a constant copper and sodium hydroxide level. As shown, the response follows the concentration changes well.

Experimental data was collected to generate a copper absorbance curve so as to insert this curve in the software. This allows the conversion of the optical detector output voltage into grams/liter of copper for display.

Figure 3:
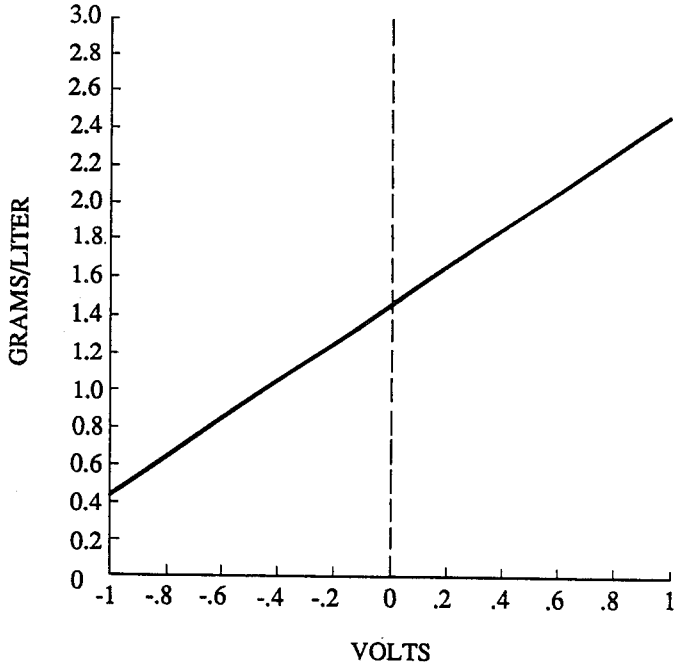
FIG. 3 is a graph showing the copper concentration determined as a function of voltage in the novel system.

FIG. 3 is a graph showing the copper concentration as a function of the voltage output from the analyzer for a typical electroless copper solution. As can be seen from this graph, a linear function having a slope which provides good sensitivity exists between the copper concentration and voltage at the wavelength employed.

The operation of the novel system was tested to determine the variations between consecutive readings on the system and comparing these to results of standard laboratory analysis methods for copper, sodium hydroxide and formaldehyde. The electroless copper test solution was run through the system for 100 minutes and each reading was recorded by the computer. Statistical analysis of the data showed the analyzer to be quite stable over this 100 minute interval. Using two standard deviations, the variation for each component was as follows:

| | |
|---|---|
| Copper | +0.34% |
| Sodium Hydroxide | +1.26% |
| Formalydehyde | +0.33% |

Testing of the system in a 100 gallon plating tank using a commercially employed electroless copper bath for an 18 hour plating cycle gave the following results from 900 data points for each component controlled by the system to the predetermined setpoints.

| | | |
|---|---|---|
| Copper | ±9.9% | |
| Sodium hydroxide | ±8.1% | |
| Formaldehyde | ±13.1% | (without correction for concentration interference) |

Since optical means are employed for determining the concentration of the various constituents, air bubbles which may be drawn in with the sample may cause errors in the optical endpoint detection. It is therefore preferred, especially where air sparging is employed in the electroless plating bath, to eliminate these bubbles by means of a recirculating pump with a debubbling connection to the sample tube.

It was further discovered that there is an optical interference between the phenolphthalein indicator and the copper in solution. The absorbance curves for copper and phenolphthalein overlap at the 550 nm wavelength used for the pH optical detectors. This overlap causes an apparent shift in the optical density of the indicator when the copper level changes. This led to a change in the stepping motor speed and an error in the sodium hydroxide and formaldehyde readings. To overcome this problem, one may either use a different optical indicator where no such interference would be observed or, one may generate a curve experimentally that shows the error at various copper levels and insert this into the software to correct for the copper-indicator interference when computing the sodium hydroxide and formaldehyde concentration.

Figure 4:
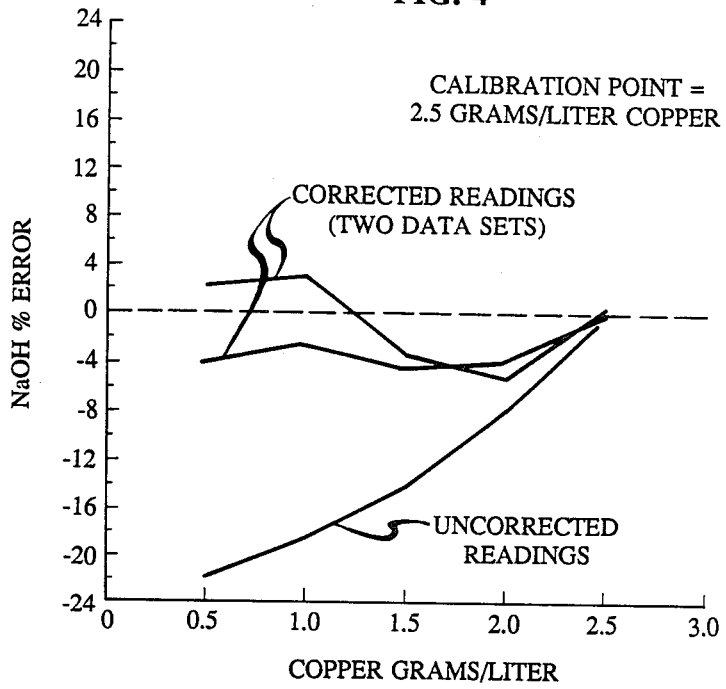
FIG. 4 is a graph showing the percent error of analyzed values versus the values of sodium hydroxide concentration, but with and without corrections for copper concentration.

FIG. 4 is a graph showing the percent error of analyzed values versus the values of sodium hydroxide concentrations with and without corrections for copper concentrations. With these corrections, a ±10% control using the novel system can be accomplished. It has further been found to be preferred to use a high flow rate pump to reduce the delay of sample travel. When this is done the control is further improved.

Figure 5:
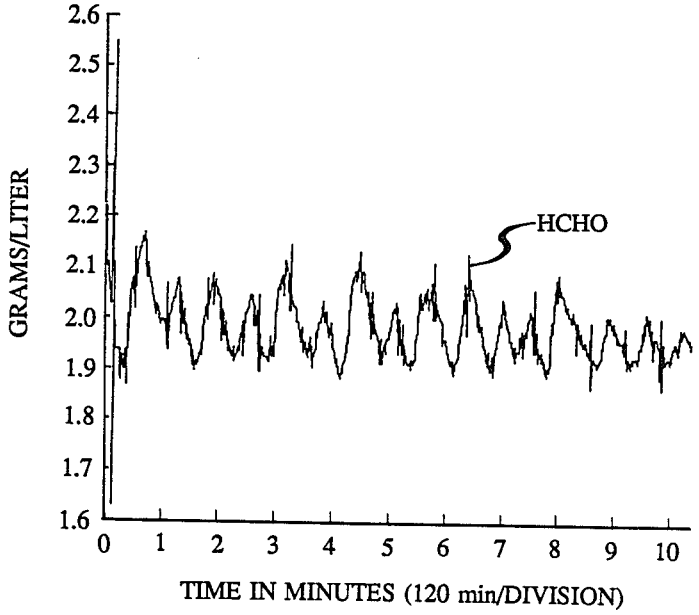
FIG. 5 is a graph showing the on-line read-out of formaldehyde concentration as a function of time as read and controlled by the novel analyzer-controller system.

FIG. 5 is an on-line read out of formaldehyde concentration as a function of time as read and controlled in accordance with this invention. The depletion of formaldehyde, followed by formaldehyde make-up gives rise to the oscillating function observed.

What is claimed is:

1. An in-line method for analyzing and controlling the concentration of constituents of an electroless copper plating bath including copper ion, hydroxyl ion and formaldehyde comprising:

(a) continuously diverting a sample portion of said bath through a first spectrophotometric optical cell;

(b) creating an electrical signal which is a function of absorbance of light passing through said cell at a wavelength within an absorption band of copper in the solution so as to determine the copper concentration in the solution;

(c) sending said signal to a signal processing means for generating a display of the measured concentration and which further compares said measured concentration with a standard concentration for generating a control signal and sending the control signal to means for controlling the amount of a copper make-up solution to be added to the plating bath to replace depleted copper ion;

(d) continuously passing the sample portion from said first optical cell into a first mixing cell where said sample is mixed with a processor controlled quantity of pH indicator and an acid titrant which are also added to the mixing cell;

(e) passing the mixed sample from the first mixing cell into a second spectrophotometric optical cell, for determining, by acid titration to a colorimetric end point, the concentration hydroxyl ions in said sample from an electrical signal which is a function of said hydroxyl ion concentration;

(f) sending said hydroxyl ion concentration related electrical signal to said signal processing means for generating a display of said concentration and which compares said concentration against a standard to generate a control signal, sending said control signal to means for controlling the amount of the addition of fresh sodium hydroxide solution in a make-up reservoir into the plating bath, responsive to said control signal;

(g) passing the sample from said second spectrophotometric optical cell into a formaldehyde reaction cell;

(h) adding a processor controlled quantity of sulfite solution to the sample in said reaction cell to form an acid titratable species and then passing the sample into a titration cell wherein a controlled quantity of sulfuric acid solution is added to said titration cell and passing said solution to a third spectrophotometric cell for determining the concentration of formaldehyde in said sample from an electrical signal generated as a function of said titration determined formaldehyde concentration;

(i) sending said formaldehyde concentration related signal to said signal processing means for generating a display of the measured formaldehyde concentration and which further causes said measured concentration with a standard concentration for generating a formaldehyde control signal and sending said formaldehyde control signal to means for controlling the amount of a formaldehyde make-up solution added to the plating bath; and (j) discarding the sample solution.

2. The method recited in claim 1 including the step of correcting the initial processor determined quantity of hydroxyl ion for any error arising from the copper concentration, prior to creating said hydroxyl ion display and control signal.

3. The method recited in claim 1 including the step of detecting and controlling the concentration of cyanide ion in said bath.

4. The method recited in claim 3 wherein said cyanide is detected by means of a specific ion electrode.

5. An in-line method for analyzing and controlling the concentration of constituents of a first mixture including a first chemical, the concentration of the first chemical affecting the pH of the mixture in a first direction, characterized by:

flowing a portion of the first mixture including the first chemical to a first mixing cell;

mixing the portion with a pH indicator;

flowing into the first mixing cell a second chemical which affects pH in a second direction opposite the first direction, thereby to obtain a second mixture;

detecting the color density of the second mixture, said color density being a function of the pH of the second mixture; maintaining a substantially predetermined color density of the second mixture by varying the rate at which the second chemical is introduced to the first mixing cell, said rate being a function of the concentration of the first chemical in the portion flowing from the first mixture, whereby the concentration of the first chemical in the first mixture can be determined;

flowing the second mixture from the first mixing cell to a second mixing cell;

adding a third chemical to the second mixture which reacts with any formaldehyde to increase alkalinity, thereby obtaining a third mixture;

detecting the color density of the third mixture, said color density being a function of the pH and therefore of formaldehyde concentration in the third mixture; and flowing into the third mixture acid at a sufficient rate to maintain the color density of the third mixture at a predetermined value, whereby the concentration of the formaldehyde in the second mixture can be determined.

6. The method of claim 5 further characterized in that:

data concerning the rate of at which the second chemical is introduced into the first mixing cell is used to control automatically and continuously the introduction of the first chemical into the first mixture so as to maintain the concentration of the first chemical within a predetermined range.

7. The method of claim 6 further characterized in that:

the first chemical is a hydroxide, and the second chemical is an acid.

8. The method of claim 6 further characterized by:

using the first mixture as an electroless bath to deposit copper onto a substrate;

and performing all of the foregoing steps substantially continuously and concurrently with the copper deposition step, whereby the chemical composition of the bath is continuously maintained within a predetermined composition range during its use.

9. The method of claim 6 further characterized in that:

data concerning the rate at which acid is added to the third mixture is used to control automatically and continuously the introduction of formaldehyde into the first mixture so as to maintain the concentration of formaldehyde within a predetermined range.

10. The method of claim 5 further characterized in that:

the third chemical is a sulfite solution.

* * * * *